US005390620A

United States Patent [19]

Murphy, deceased et al.

[11] Patent Number: 5,390,620

[45] Date of Patent: Feb. 21, 1995

[54] FLOATABLE DOCK

[75] Inventors: Gary W. Murphy, deceased, late of Whitby; Denyse Dumoulin, executor, Ile Perrot; William J. Barnes, Claremont, all of Canada

[73] Assignee: Techstar Plastics Inc., Port Perry, Canada

[21] Appl. No.: 99,579

[22] Filed: Jul. 30, 1993

[51] Int. Cl.[6] ..... B63B 35/00

[52] U.S. Cl. ..... 114/263; 114/266; 14/27

[58] Field of Search ..... 14/2.4, 2.6, 27, 28, 14/30, 18, 69.5; 114/263, 266, 267

[56] References Cited

U.S. PATENT DOCUMENTS 2,858,790 11/1958 Russell .
2,986,749 6/1961 Webber et al. .
3,073,271 1/1963 Brill .
3,970,024 7/1976 Fisher ..... 114/266
4,041,716 8/1977 Thompson .
4,709,647 12/1987 Rytand ..... 114/266
4,993,350 2/1991 Pepper ..... 114/267
5,199,371 4/1993 Meriwether ..... 114/267

*Primary Examiner*—Ramon S. Britts
*Assistant Examiner*—Pamela Anne O'Connor
*Attorney, Agent, or Firm*—Ridout & Maybee

[57] ABSTRACT

A dock float having a sealed elongated buoyant hollow housing with at least one longitudinal channel for securing a joist to which decking is supported. A floatable marine dock is constructed by interconnecting two similar floats by securing header boards in laterally extending recesses in the ends of each float. The width of the floatable dock is determined by the length of the header boards and decking. The length of the floatable docks may be varied by juxtapositioning in an end to end manner any required number of floats.

16 Claims, 5 Drawing Sheets

FLOATABLE DOCK

FIELD OF THE INVENTION

This invention relates to a floatable marine dock, of the type in which floatation devices support a deck.

BACKGROUND OF THE INVENTION

Various designs of floatable marine docks are known. A typical construction for a floatable marine dock is shown in U.S. Pat. No. 2,986,749 ('749), T. J. Webber et at., issued on Jun. 6, 1961. Patent '749 discloses a floatable dock having a rectangular frame made of aluminium and deck plates connected thereto. For buoyancy, a floatation device consisting of a foam plastic substance is positioned inside the frame.

It is known to substitute suitable materials in the floatable dock construction disclosed in Patent '749 depending on its intended application and cost. For example, the frame and decking may be made of suitable metals, plastics or woods. In addition, floatation devices may be in the form of metal or plastic barrels or drums; women boxes; or hollow fibreglass structures.

Floatable marine docks are commonly used on bodies of water that are difficult to access. Consequently, prefabricated floatable docks are difficult to transport to the body of water on which they are to be used due to their shape and size. Furthermore, the construction of a floatable marine dock, for example the floatable dock disclosed in Patent '749, is complex and, accordingly, requires special tools and significant labour and skill. Thus, a floatable dock having a simple construction that could be quickly and easily assembled by a carpenter or handyman using standard tools and a minimum of materials would be desirable.

SUMMARY OF THE INVENTION

An object of the present invention is to provide a floatable dock, which addresses the above and other problems.

The present invention provides a dock float for a floatable dock comprising a sealed, elongated buoyant housing having end walls, a top wall, a bottom wall, an inner side wall and an outer side wall; said housing defining, at least one longitudinal channel within which at least one joist is securable so as to present a supporting surface for decking; and in each end wall a laterally extending recess alignable with a corresponding recess in an end of a further similar parallel dock float to receive and secure at least one board for interconnecting said floats.

In another aspect the invention provides a floatable dock comprising a first and second dock float each comprising a sealed, elongated buoyant housing having end walls, a top wall, a bottom wall, an inner side wall and an outer side wall; said housing defining, at least one longitudinal channel within which at least one joist is securable so as to present a supporting surface for decking; and in each end wall a laterally extending recess alignable with a corresponding recess in an end of the other similar parallel dock float to receive and secure at least one board for interconnecting said floats; at least two joists at least one of which is receivably retained in at least one longitudinal channel of each dock float; at least two header boards, at least one header board being secured in the recesses at opposite ends of said first and second dock floats, which are arranged parallel with their respective inner side walls facing each other;, and decking secured to and above said joists.

Advantages of the present invention include the provision of a floatable dock having a simple construction; improved stability; low profile; and which may be constructed to variable widths.

BRIEF DESCRIPTION OF THE DRAWINGS

The present invention will be further understood from the following description with reference to the drawings in which.

Similar references are used in different figures to denote similar components.

DETAILED DESCRIPTION OF THE PREFERRED EMBODIMENT

Figure 1:
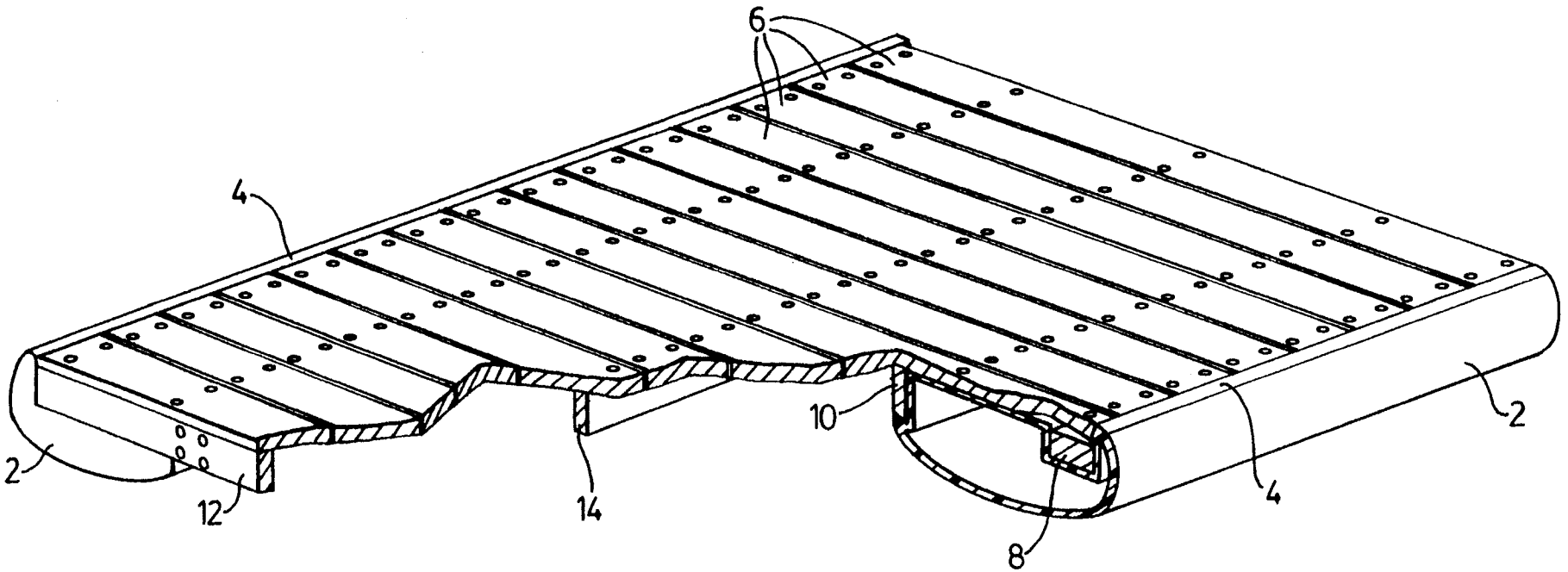
FIG. 1 is a cut away isometric view from above and one end and side of a floatable dock in accordance with an embodiment of the present invention.

Referring to FIG. 1, a first and second dock floats 2 each having an identical construction are positioned parallel to each other with raised surfaces 4 of each float away from each other, such that framing and decking of the floatable dock may be supported thereby. The decking consists of deck boards 6 secured to framing supported by each of the first and second dock floats 2, including a top float joist 8; a side float joist 10; and header boards 12 (only one is shown in FIG. 1 ). A centre joist 14 may also be positioned along the centre of the underside of the deck boards 6.

Figure 2:
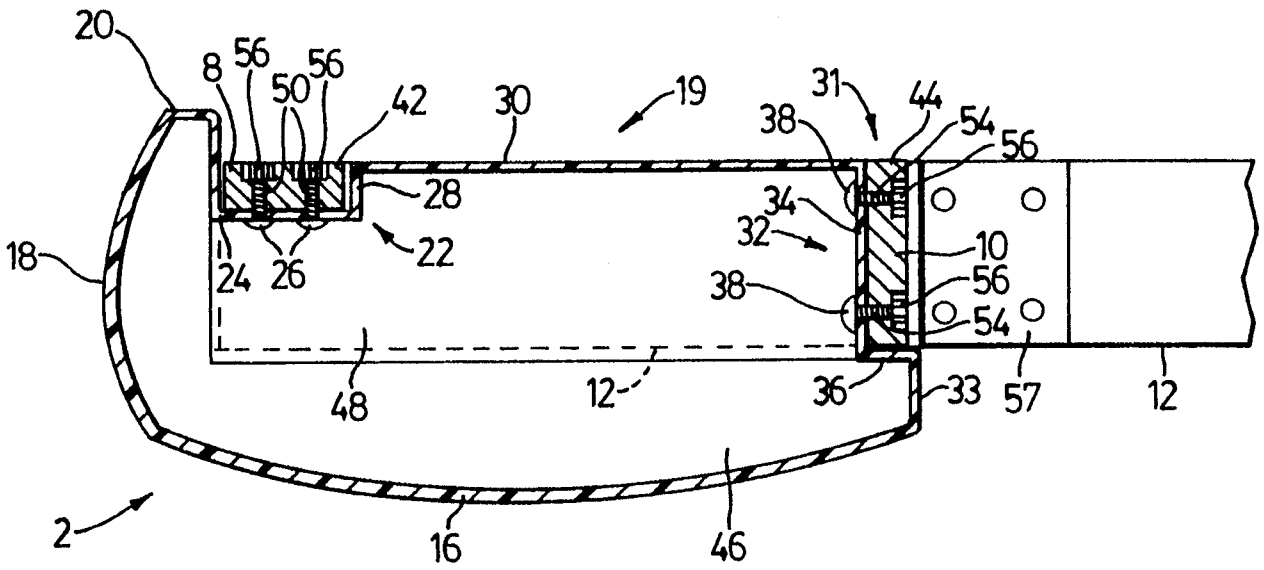
FIG. 2 is a cross sectional end view along line 2—2 in FIG. 3 and illustrates a dock float used in the floatable dock of FIG. 1.
Figure 3:
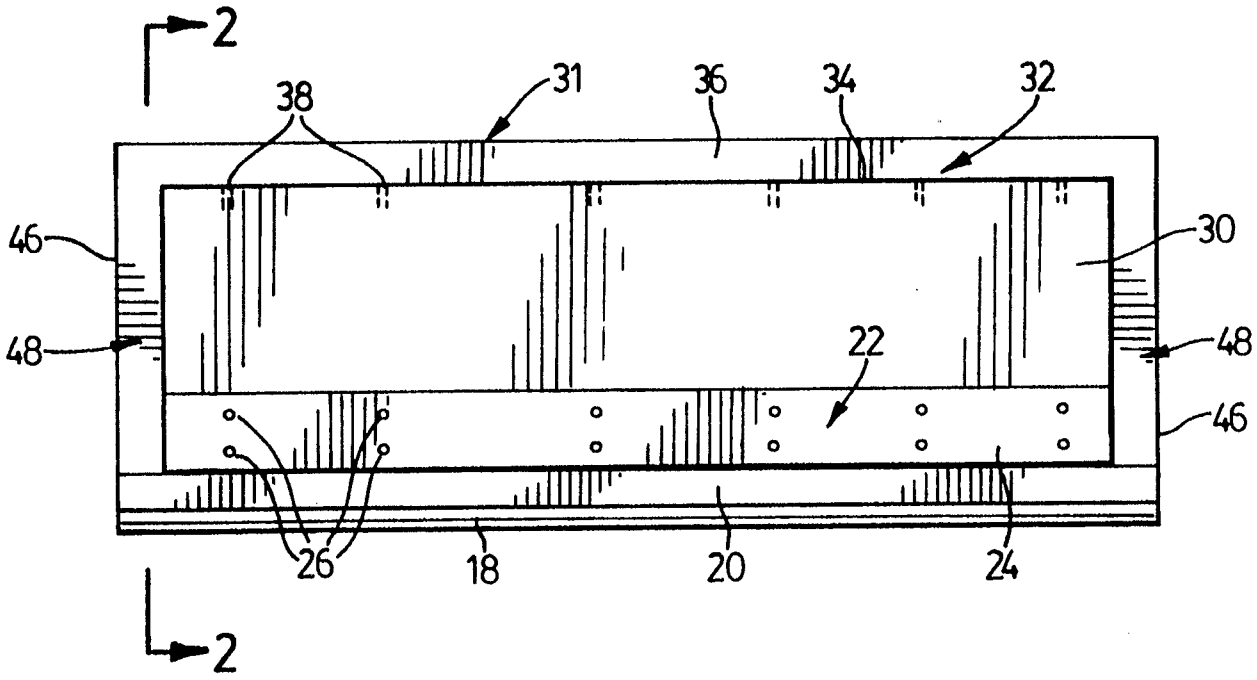
FIG. 3 is a plan view of a dock float used in the floatable dock of FIG. 1.

The first and second dock floats are buoyant and each have a hollow construction. They are molded from polyethylene or other synthetic plastic resin, with or without reinforcement. The construction of the dock floats may be more clearly understood with reference to FIGS. 2 and 3.

Each of the dock floats 2 has an externally convex bottom wall 16 which joins an externally convex outer side wall 18. A top wall 19 consists of the raised horizontal surface 20; a U-section channel 22; and a platform surface 30. The raised horizontal surface 20 extends outwardly to an edge of the outer side wall 18. Inwardly of the horizontal surface 20, the top wall 19 defines the U-section channel 22 having a base 24. Several pairs of threaded inserts 26 are integrally moulded into the base 24 at predetermined positions along the length of the channel 22. The inserts 26 are moulded in place in a manner which ensures that the dock float remains fully enclosed or airtight. Inwardly of the upwardly extending side wall 28 of the U-section channel 22, the wall 19 extends horizontally to form the platform surface 30. An inner side wall 31 of the float defines an L-section channel 32 above a vertical surface 33. The inner edge of the platform surface 30 joins a side wall 34 of the channel 32 which extends vertically downwardly to form the L-section channel 32 in conjunction with a base wall 36. A plurality of pairs of threaded inserts 38 are integrally moulded at predetermined positions along the length of the wall 34. The inserts 38 are again moulded in place in a manner which ensures that the dock float remains fully enclosed or airtight. The vertical surface 33 extends downward from the outermost edge of the wall 36 to join the bottom wall 16.

Figure 4:
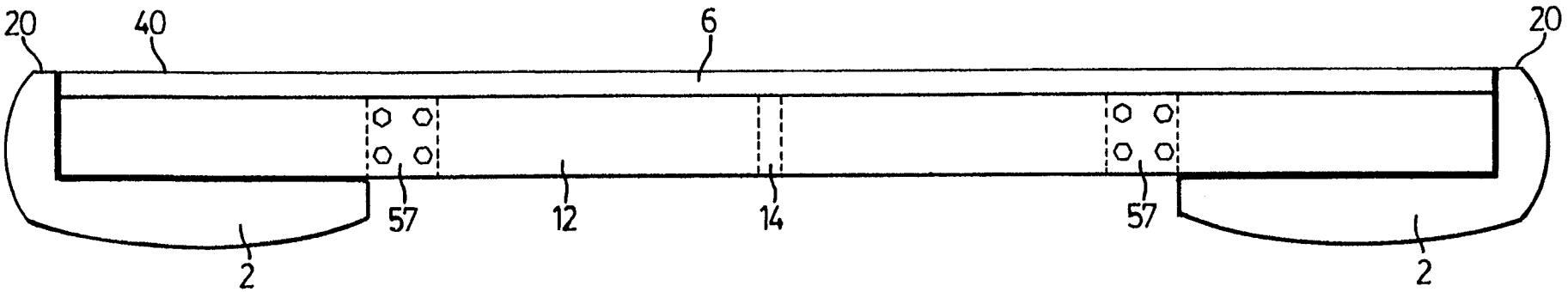
FIG. 4 is an end view of the floatable dock of FIG. 1.

The level of the surface 30 relative to the level of the surface 20 is such that when the deck boards 6 are positioned against the platform surface 30, the horizontal surface 20 is approximately aligned with top surfaces 40 of the deck boards 6, as shown in FIG. 4. The depth of the U-section channel 22 is such that when a top float joist 8 is positioned therein the exposed top surface 42 of the joist 8 is approximately aligned with the platform surface 30. The L-section channel 32 is dimensioned to receive a side float joist 10 such that when the side float joist 10 is positioned therein its exposed horizontal side 44 is approximately aligned with the platform surface 30.

The end walls 46 of both ends of both dock floats are planar except for an L-section recess 48 of similar dimensions to the channel 32 is formed in each end. The recesses 48 are adapted to receive header boards 12. The depth of the recesses 48 is such that when header boards 12 are positioned therein their exposed vertical surfaces are approximately aligned with the end walls 46, and their exposed top surfaces with surface 30.

The average thickness of the moulded material of the dock floats 2 is preferably about 0.2 inches. Typically, the side wall 18, which may be required to act as a fender, will be thicker than the other walls. The thickness and externally convex shape of the side wall 18 enables it to act as a fender to cushion impacts between the dock and boats or other objects which may come into contact with the dock float.

In order to assemble a floatable dock, the first and second dock floats 2 are oppositely disposed along their length as shown in FIG. 1 with the inner side walls 31 facing each other. For each of the dock floats, the top float joist 8, preferably a nominal two by four inch board, is fastened in the U-section channel 22, typically by securing bolts 50 through the joist 8 into the threaded inserts 26. Preferably, the heads 52 of the bolts 50 are recessed into the joist 8. Similarly, the side float joist 10, preferably a nominal two inch by six inch board, is fastened in the L-section channel 32, typically, by securing bolts 54 through the joist 10 into the threaded inserts 38. The heads 56 of bolts 54 are, preferably, recessed into joist 10.

The dock floats are then interconnected using header boards 12. The length of the header boards 12 determines the width of the floatable dock, which is preferably less than 10 feet. The header boards 12 are positioned in the L-section recesses 48 in the aligned ends of the first and second dock floats 2. The header boards 12 are fastened to the dock floats 2, preferably by using corner plates 57 which are connected to the header boards 12 and side float joists 10. In order to add additional stability to the structure the center joist 14 may be positioned lengthwise intermediate the first and second floats 2 and fastened to the header boards 12 and deck boards 6.

Each of the deck boards 6, which is of the same length as the header boards 12, is then spaced apart as desired and fastened to the top float joists 8 and side float joists 10, for example, as shown in FIG. 1.

Figure 5:
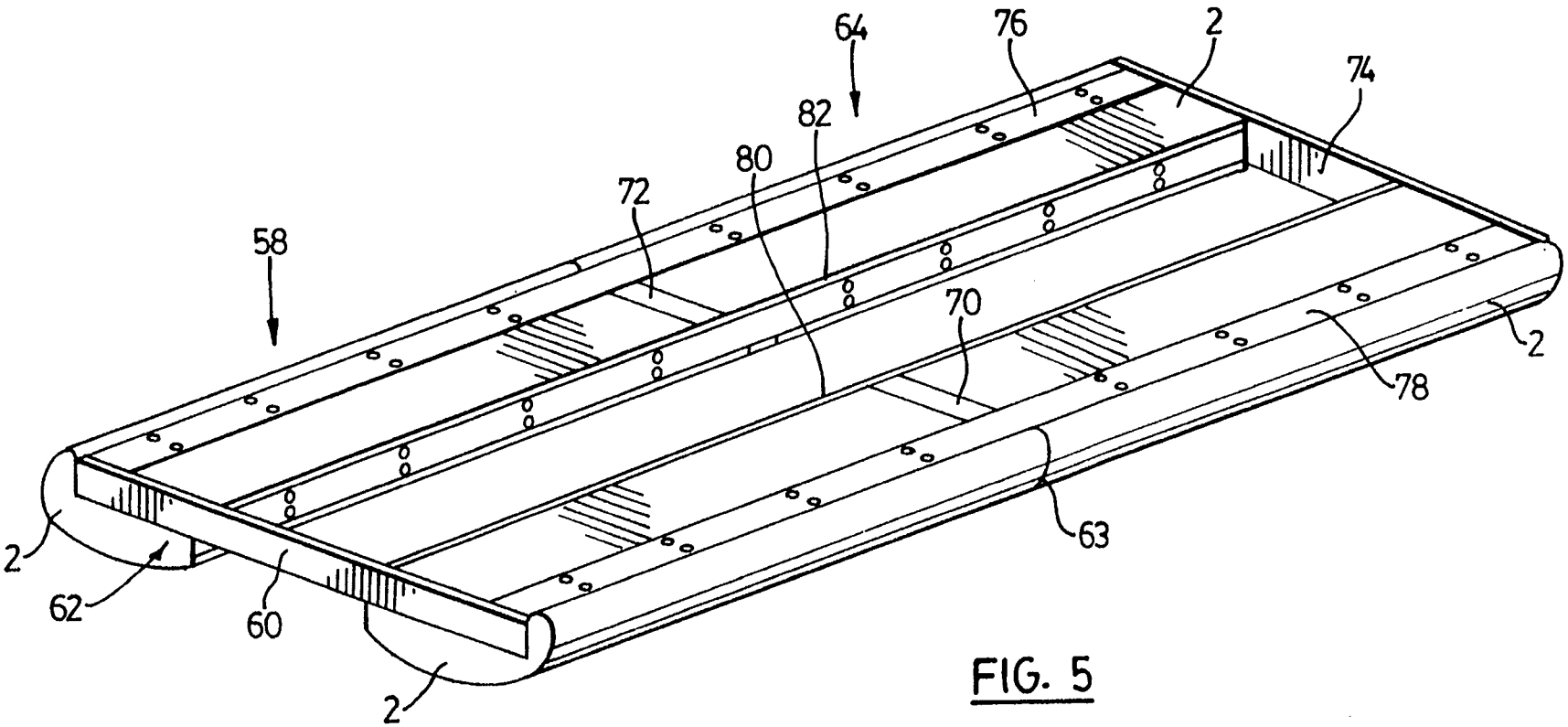
FIG. 5 is an isometric view from above and one end and side, and before installation of decking, showing a floatable dock in which dock floats are connected end to end to provide greater length.

FIG. 5 shows a floatable dock generally similar to that of FIG. 1 but with floats 2 secured end to end. It will be understood by persons skilled in the art that the length of the floatable dock can be varied by juxtapositioning in an end to end manner any required number of floats 2. A first floatable dock portion 58 has a header board 60 attached to a near end 62. The first floatable dock portion 58 and a second floatable dock portion 64 are juxtapositioned in an end to end manner and their floats are in abutting contact in a plane 63. Apertures 70 and 72 are formed by the adjoining L-section recesses at the ends of the abutting dock floats 2. The second floatable dock portion 64 has a header board 74 attached to the far end. The first floatable dock portion 58 is connected to the second floatable dock by top float joists 76 and 78 and side float joists 80 and 82.

It will be noted that, using the floats 2, docks of a wide range of lengths and widths may be assembled by the use commonly available lumber and hardware such as bulk and comer pieces, all components being readily portable. Furthermore, it will be understood by persons skilled in the art that the header boards 12, side float joists 10, center joist 14, top float joists 8 and deck boards 6 may be constructed of suitable lumber, plastics or metals.

Numerous modifications, variations and adaptations may be made to the particular embodiment of the invention described above without departing from the scope of the invention, which is defined in the claims. For example the decking could be formed from sheet material rather than separate planks.

We claim:

1. A dock float for a floatable dock, comprising:

a sealed, elongated, enclosed, buoyant housing having end walls, a top wall, a bottom wall and inner side wall and an outer side wall;

said housing defining at least one upwardly opening longitudinal channel for receiving a longitudinal joist forming a longitudinally extending frame member of a deck, means being provided within each said longitudinal channel for securing a joist therein; and said housing further defining at least two longitudinally spaced laterally extending and upwardly opening channels alignable with corresponding laterly extending channels of a similar parallel dock float to receive laterally extending frame members of said deck.

2. A dock float as claimed in claim 1, wherein said at least one longitudinal channel includes a channel of U-section and located intermediate longitudinal edges of said top wall.

3. A dock float as claimed in claim 1 wherein said at least one longitudinal channel includes a channel of L-section and located at an inner edge of said top wall in said inner side wall.

4. A dock float as claimed in claim 1, wherein said laterally extending channels are of L-section and located at opposite ends of the float.

5. A dock float as claimed in claim 1 wherein said outer side wall is externally convex.

6. A dock float as claimed in claim 5, wherein said bottom wall is externally convex.

7. A dock float as claimed in claim 1, wherein said means for securing a longitudinal joist comprise a plurality of threaded inserts located at predetermined longitudinally spaced positions within said at least one longitudinally extending channel.

8. A dock float as claimed in claim 7, wherein said housing is moulded from synthetic plastic resin, and the threaded inserts are integrally moulded into the housing at said predetermined positions.

9. A dock float as claimed in claim 2, wherein said U-section channel is adapted to receive and retain a joist such that the top surface of the joist lies in substantially the same plane as a major portion of the top wall.

10. A dock float as claimed in claim 3, wherein said L-section channel is adapted to receive and retain a joist such that exposed surfaces of the joist lie substantially in the same planes as a major portion of the top wall and a portion of the inner side wall beneath the recess.

11. A dock float as claimed in claim 1, wherein the walls of said housing are integrally moulded from polyethylene.

12. A dock float as claimed in claim 1, wherein the housing defines a first longitudinal upwardly opening channel of U-section intermediate longitudinal edges of the top wall, a second longitudinal upwardly opening channel of L-section at an inner edge of said top wall in said inner side wall, and wherein the means for securing joists within said longitudinally extending channels are bolts extending vertically in said first channel and horizontally in said second channel.

13. A floatable dock comprising:

a deck;

first and second parallel dock floats, each dock float comprising a sealed, elongated, enclosed, buoyant housing having end walls, a top wall, a bottom wall, an inner side wall and an outer side wall; said housing defining at least one upwardly opening longitudinal channel for receiving a longitudinal joist forming a longitudinally extending frame member comprised by said deck, and having means within each said longitudinal channel securing the joist received therein; said housing further defining at least two longitudinally spaced laterally extending and upwardly opening channels aligned with corresponding laterally extending channels of the other parallel dock float, said laterally extending channels receiving laterally extending frame members comprised by said deck, said dock floats being arranged with their respective inner side walls facing each other; and said deck further comprising decking secured to and above said frame members.

14. A floatable dock as claimed in claim 13, wherein each dock float comprises a plurality of housings juxtapositioned in an end-to-end manner, the end-to-end housings being interconnected by said longitudinal joists.

15. A floatable dock as claimed in claim 13, wherein a centre longitudinal joist is fastened beneath the decking and between and parallel to the first and second floats.

16. A floatable dock as claimed in claim 13, wherein said laterally extending frame members are secured in position by corner plates fastened between the laterally extending frame members and the longitudinally extending frame members of the deck.

* * * * *